US009676021B2

(12) United States Patent
Lozano Bonet

(10) Patent No.: US 9,676,021 B2
(45) Date of Patent: Jun. 13, 2017

(54) STAMPING PRESS

(75) Inventor: José Lozano Bonet, Valencia (ES)

(73) Assignee: Lapmaster International L.L.C., Mount Prospect, IL (US)

( * ) Notice: Subject to any disclaimer, the term of this patent is extended or adjusted under 35 U.S.C. 154(b) by 359 days.

(21) Appl. No.: 14/412,064

(22) PCT Filed: Jul. 6, 2012

(86) PCT No.: PCT/IB2012/053469

§ 371 (c)(1),
(2), (4) Date: Dec. 30, 2014

(87) PCT Pub. No.: WO2014/013290

PCT Pub. Date: Jan. 23, 2014

(65) Prior Publication Data

US 2015/0183020 A1 Jul. 2, 2015

(51) Int. Cl.

| | |
|---|---|
| ***B21D 53/28*** | (2006.01) |
| ***B21D 22/12*** | (2006.01) |
| ***B21D 22/08*** | (2006.01) |
| ***B21D 22/06*** | (2006.01) |
| ***B21D 28/16*** | (2006.01) |

(52) U.S. Cl.

CPC ..... *B21D 53/28* (2013.01); *B21D 22/06* (2013.01); *B21D 22/08* (2013.01); *B21D 22/12* (2013.01); *B21D 28/16* (2013.01)

(58) Field of Classification Search

CPC ..... B21D 53/28; B21D 22/02; B21D 22/06; B21D 22/08; B21D 22/12; B21D 22/14; B21D 22/145; B21D 22/16; B21D 22/30; B21D 22/36; B21D 45/00; B21D 45/003; B21D 45/006; B21D 45/02; B21D 45/04; B21D 45/06; B21D 45/08; B21D 45/10; B21D 35/001; Y10T 29/49472; Y10T 29/49474

See application file for complete search history.

(56) References Cited

U.S. PATENT DOCUMENTS

| | | | | |
|---|---|---|---|---|
| 3,394,432 A | | 7/1968 | Laurent | |
| 3,909,167 A | * | 9/1975 | Signora | B22F 5/08 29/893.3 |
| 4,951,537 A | * | 8/1990 | Bennett | B21D 45/006 267/119 |
| 5,366,363 A | * | 11/1994 | Good | B22F 5/08 425/352 |

(Continued)

FOREIGN PATENT DOCUMENTS

| | | | | |
|---|---|---|---|---|
| CA | 2196560 C | | 9/2006 | |
| DE | EP 2208552 A1 | * | 7/2010 | B21D 28/02 |

(Continued)

*Primary Examiner* — Jimmy T Nguyen
*Assistant Examiner* — Gregory Swiatocha
(74) *Attorney, Agent, or Firm* — Richard M. Goldberg

(57) ABSTRACT

A stamping press includes a first body (200) and a second body (100,300), at least one of them having axial movement, the first body have a third body (255) with controlled rotary movement capability, and the second body have a fifth body (115,350) that also has rotary movement, the third body (255) and the fifth body (115,350) rotary movements as well as the axial movements from the first body (200) and the second body (100,300) are independent with respect to each other.

19 Claims, 11 Drawing Sheets

(56) References Cited

U.S. PATENT DOCUMENTS

| | | | |
|---|---|---|---|
| 6,729,172 | B2 | 5/2004 | Aizaki |
| 7,854,995 | B1 | 12/2010 | Anderson |
| 2007/0157693 | A1 | 7/2007 | Chiesa |

FOREIGN PATENT DOCUMENTS

| | | | | | |
|---|---|---|---|---|---|
| EP | 0131770 | A1 | | 1/1985 | |
| EP | 0528761 | A1 | | 2/1993 | |
| EP | 2208552 | A1 | | 7/2010 | |
| GB | 1419770 | A | * | 12/1975 | ..... B22F 5/08 |
| IT | 1137113 | B | | 9/1986 | |
| JP | 55070426 | A | * | 5/1980 | |

* cited by examiner

STAMPING PRESS

BACKGROUND OF THE INVENTION

The present invention relates to a stamping press that allows to manufacture parts with straight, helical or angular cutting edges, even with constant or variable pitch as well as all its combinations; the press is composed by at least one first body and one second body, at least the first of these bodies has a rotary movement, synchronized with its own linear pitch movement or with a second body movement; the second body has a free rotary mechanism or a rotary mechanism synchronized with the first body.

To produce parts or components with helical or angular edges is a priority need in the mechanical light, medium and heavy industry, for instance for gear productions. Traditionally these kinds of parts have been produced by machining the teeth on the gears, and today still being the main production process to manufacture these kinds of parts, nevertheless some specific and very complex tooling for conventional presses have been built and also for presses with different actions like fine blanking presses.

There are complex parts with different geometries on its own contour and having some of itself helical or angular grooves, some of these complex parts must be manufactured in several different operations, whenever the different operations have to be done in different machines or with different tooling, including previous or secondary operations to the stamping operation of the part.

STATE OF THE ART

IT 1137113 describes a process to stamp gear wheels with a helical edge and the final product obtained; this invention describes a complex tooling that produces the stamping of the part inside it, as an example a gear wheel, the tool is composed by a punch, a die, a counter punch, the punch produces a rotary movement against the counter punch through a pivot which is a different round shape, this pivot is inserted into a hole with the same shape into the counter punch, in order to do this the metal that will be transformed into the final part must have an initial hole so the pivot from the punch can be introduced through it into the cavity of the counter punch. So a previous operation in the metal is needed. Due to the high complexity of this kind of the tool component the tool cost is so high, these tools are only useful for the part that they have been designed, so there is no flexibility on the same tool to produce different part models or designs, this means that a similar part will require a complete new tool with its high cost and lead time.

This method only allows the production of parts with an external or internal helical constant cutting pitch, so this method is unable to produce internal or external helical variable cutting pitch.

EP 0131770 describes a process for fine blanking parts and a tooling to produce these parts. According to this invention the gear wheels are cut with straight edges and the teeth are conical, these conical teeth are produced in several steps and the tool has no synchronized rotary and linear movement.

U.S. Pat. No. 6,729,172 describes a tooling and a process to manufacture gear wheels with a straight cutting edge.

EP 2208552 refers to a procedure and a device to manufacture precision parts. The method and the tooling used are similar to IT 1137113. In this case as well as in IT 1137113, only parts with an external contour with helical constant cutting edge can be manufactured, but in this case, an internal shape can also be produced into the part with a straight cutting edge.

In all the documents described above, the technical specifications belong exclusively into the tooling to be used in a standard press. The main problem of these methods is that every different part to be produced needs a fully complete new tooling with all the synchronized elements for the movements inside. This means that every different part needs a specific tooling with a high cost involved for it. This tool will be useless for any other part design.

Another major problem is that these tools are able to produce helical or angular constant cutting edges only over the final parts. These tools only permit one synchronized rotary and lineal movement as it is predetermined in the tool design.

In addition the most advanced tooling (Feintool AG) only have the capability to produce parts with an external contour with helical or angular constant cutting edges at the same time that it is produced and an internal pierced hole with a straight cutting edge and a round shape, and by the way, they also can produce an external round contour with a straight cutting edge at the same time that they produce an internal pierced hole with a helical or angular constant cutting edge, in both cases the pierced holes must be produced over the part center.

The cutting pitch (relation between the lineal feed movement and the rotary movement) helical or angular in all documents described above are constant and predetermined by the tooling design.

In addition, with the technique described above, it is not possible to create pierced holes outside of the main part center during the same production cycle at the same time that pierced holes or external part contours with helical or angular cutting edges are being produced.

In addition, the state of the art does not allow to produce at the same time parts with an external contour and an internal contour, (from a pierced hole), with different cutting pitch or different rotary relative movement directions during a single production operation or cycle.

An added problem is that commonly in the fine blanking processes the slugs coming from the pierced holes must be take off from the working tool area together with the manufactured parts, and this makes the cycle time longer and frequently a slug still inside the tool working area creates an emergency stop in the production to avoid tool breakage.

Since every single part design needs its own tool design with a certain specific pitch and shape, any added modification to the part design will require automatically a tool modification, increasing tool cost.

The tooling described in the state of the art have a large degree of complexity, their cost to be manufactured and repaired are so high, and mainly are specific for each part design, and specially, for this reason, it is not possible to use it for a different part than the one that was designed for.

SUMMARY OF THE INVENTION

The present invention describes a stamping press which introduces several technical advantages that solve the problems described above, simplify the tool design and makes possible to manufacture different part designs even using the same tooling by changing press process parameters, making possible a flexible production. As an example to produce a very simple part with an external contour or a pierced hole with a helical or angular cutting edge, even with a constant or a variable pitch, or just with different pitch size will require only two cutting tool components, a punch and a die, and this generates for the user a major flexibility with a very low tooling cost.

The stamping press is formed by:

A first body

A second body

At least one of these bodies having lineal movement respect to the other one, allowing to approach each other or to move away.

According to the invention the press also contains in the first body:

A third body, that has rotary movement with respect of the first body, the rotary movement will be created by a mechanism or an operation motor, for example hydraulic or electrical; this third body can be hollow or can hold an internal mechanism that will have the capability to produce different movements, for example lineal and rotary movements and its combinations; in turn this third body in addition to its capability to generate rotary movements will have the possibility to have a lineal movement mechanism; the rotary or axial movements of this third body are independent from the first and the second body, although synchronized cycle movements can be programmed; and the third body can hold a single or a multi head spindle.

A fourth body with axial (linear) movement capability respect to the first body that supports it; this fourth body can be composed of a number of actuator cylinders around the third body or can be built into a unique hollow cylinder that supports inside said third body.

And in the second body:

A fifth body, that will have a free rotary movement capability or a controlled rotary movement due to a mechanism or a motor that produces that movement, for example hydraulic or electrical; this fifth body also has an axial (linear) movement; the rotary or axial movements of this fifth body are independent from the first, the second and the third bodies, and even though those bodies will be able to work out synchronized movements with respect to each other, the fifth body can have one or more independent single spindle heads, or multiple spindle heads.

For a better understanding of the different embodiments we will call the first body as the lower body and the second body as the upper body, just as an example; in any case the upper and lower positions can be inverted or the stamping press can be in a different position as an example in horizontal position. Also some of the elements described for the upper or lower bodies can be placed in the other one.

Thus, in a basic press model as an example, we will have an upper body and a lower body. The lower body has a third rotary body. This third rotary body is in a fixed position with respect to the bench of the lower body. This third body has a rotary movement due to a controlled mechanism or motor. Around the third body is a fourth body with axial (linear) movement, and this fourth body will eject the final parts or will provide other functions or operations during the process. The upper body has in its lower area a fifth body; in this basic press model the fifth body has a free rotary movement and an actuated and controlled linear movement.

For manufacturing a part with a helical cutting edge will be needed a simple tooling with a contour punch and a contour die, and it will be possible also to have a piercing punch and an upper and lower ejector. Once the tool is assembled into the press, the metal coil is placed onto the press, then the press is operated by making the upper body move down until the upper ejector makes contact with the metal of the coil; once they make contact the third rotary body starts (or continues), the rotary action at the same time than the upper body still moves down, the fifth body, with free rotary movement, that holds the part during the cutting action supports its contact position with the part, while the metal coil is being cut between the punch and the die; the fourth body moves down by the upper body action during the cutting action, and to obtain the final part an inverted movement from the upper body is produced, and the third body will turn then in an inverted direction and under a synchronized movement together the upper body movement, and the fourth body will make an elevation linear movement to eject the rest of the metal from the coil around the punch, the fifth body will make a lineal movement at the same time that will have a rotary free movement induced by the helical or angular part geometry, after the part ejection new metal from the coil will feed into the tool to create a new part with a new press cycle.

When a centered pierced hole is made the slug from that pierced hole will be ejected through the hollow third body.

According to the invention and this press model, helical or angular part contours, even with constant or variable pitch can be produced at a very low cost, in opposition to the production capabilities described in the state of the art. In these achievements, only parts with constant pitch can be manufactured at a higher tooling cost due to tool complexity due to the rotary and hydraulic components being placed into the tooling and not into the press as the present invention, and consequently they provide a higher part cost than is obtained with the present invention.

According to a second embodiment, similar to the first one, the first and second body positions are inverted, as well as their associated components. In this case the hollow of the third body will be filled with at least one internal mechanism that will make at least one linear movement in addition to a free or controlled rotary movement.

In this case if the part manufactured has a pierced hole, the slug from this pierced hole will be ejected out of the tool by the action of this internal mechanism of the third body.

In a third embodiment, the lower body is equal to the first press model. The upper body has in its lower position a fifth body; according to this third embodiment, on this third press this fifth body has a controlled rotary movement and also can have a linear controlled movement. It also includes a sixth hollow body surrounding the fifth body or composed by a certain number of cylinders placed around the fifth body, said sixth body having axial movement capability with respect to the upper body that holds it.

Thus, according to this embodiment, the following operations can be done:

A pierced hole with straight, helical or angular cutting edge into the center part;

An straight or helical external cutting edge contour;

A helical or angular external part contour together with a straight cutting edge pierced hole into the center part;

A straight cutting edge external contour and a helical or angular cutting edge pierced hole into the center part;

A helical or angular cutting edge external part contour together a helical or angular pierced hole into the center part, in this case both, the external part contour and the inner pierced hole can have different rotary cutting edge direction;

A helical or angular external part contour together straight cutting edge pierced holes out of the center part.

Any of the straight cutting edge pierced holes as well as the external straight cutting edge part contour can have any shape not limited to a round shape.

The complex shapes, usually manufactured by steps, will include not only round helical or angular shapes but also portions of them.

To manufacture a part as an example with an external helical contour with internal straight pierced holes out of the center part, using the press of the present invention according to the third embodiment, once the tool is assembled on the press the following cycle steps will be followed:

Metal feeding and positioning;

Upper press body will approach to the metal;

Synchronized rotary movement of the third and the fifth press bodies;

Upper body movement that holds the tool at the same time that the third and fifth rotary body movements are being produced obtaining a helical cutting edge on the part;

Piercing punches are moved and press into the metal by the upper body movement at the same time that the piercing punches keep the alignment position due to the synchronized rotary movement of the third and fifth bodies that holds them;

Ejection of the slugs coming from the pierced holes, and part ejection from the tool by doing the corresponding reversed movements.

The order of the operations described will be able to vary depending on the design of the part to manufacture.

According to a fourth embodiment, similar to the third one, the first and second body positions are inverted, as their associated components. In this case the hole of the third body will be filled with at least one internal mechanism that will make at least one lineal movement in addition to a free or controlled rotary movement.

According to a fifth embodiment, in addition to the elements of the press of the third embodiment, the fifth body on the press has a seventh body inserted that has at least one or more independent elements with controlled rotary movement.

According to this fifth embodiment it is possible to produce similar or equal stamping parts as the ones that can be produced with the previous described embodiments, and also, parts including pierced holes with helical or angular edges outside of the center part can be manufactured.

According to a sixth embodiment similar to the fifth one, the first and second body positions are inverted, as their associated components. In this case the hole of the third body will be filled with at least one internal mechanism that will make at least one lineal movement in addition to a free or controlled rotary movement.

According to a seventh embodiment similar to the described fifth embodiment, the independent controlled elements of the seventh body will have at least one or more controlled lineal movements.

An eighth embodiment is similar to the seventh one, but in this the first and second body positions are inverted, as their associated components. In this case the hole of the third body will be filled with at least one internal mechanism that will make at least one lineal movement in addition to a free or controlled rotary movement.

As an option the third and the fifth bodies will have the capability to make lineal controlled movements in addition to the rotary movements.

According to the invention, all the helical or angular cutting edges will be able to be manufactured with a constant or a variable pitch. In addition to this, when both helical or angular or their combinations, (for example an external contour and an internal pierced hole), can be stamped in with the same or with different cutting directions at the same time.

The presses described above in the different embodiments will be able to be part of more complex production lines in order to produce parts with helical or angular cut portions combined with straight cut portions on the same stamped part, by using complex tooling as transfer or progressive tooling.

In the same press frame can be located or assembled different operation units such as those described including all or some of their components.

BRIEF DESCRIPTION OF THE DRAWINGS

Eleven pages with eleven figures are enclosed in which the essence of the invention is represented as an example, where.

DETAILED DESCRIPTION OF THE PREFERRED EMBODIMENTS

Figure 1:
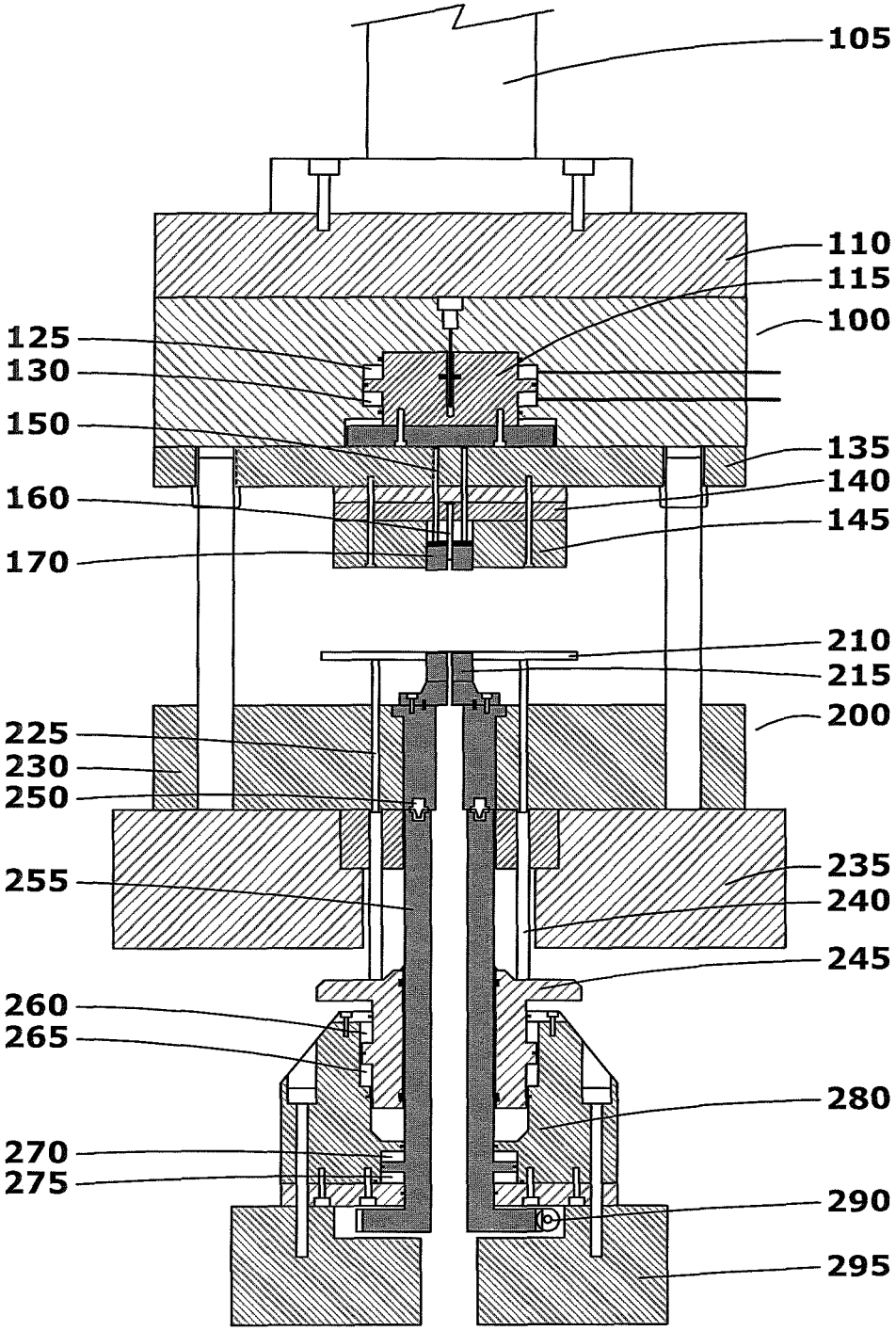
FIG. 1 shows a schematically sectional view of the press of the invention according to a first embodiment, in which a first body (represented as a lower body) represents the press bench, and where a third rotary body with hollow core and a fourth body with lineal movement are placed, and a second body that constitutes the ram of the press is provided with a fifth body with free or controlled rotary movement.

As explained above the present invention consists of a stamping press that is composed by a first body (200), usually placed in the lower position, and this first body has a bench (235), and a second body (100,300), usually placed in the upper position and constituting the ram press. The first body (200) has a third body (255); this third body (255) is placed over the press frame (295) or in the press bench (235) and has a rotary movement against the press bench (235). This third body (255) is composed of a hollow cylinder that is supported by a hydrostatic system over the press frame (295). This third body (255) will be normally supported by a hydraulic cushion (270,275), with an upper chamber (270) and a lower chamber (275). The filling or leaking action of those chambers will produce a linear movement of the third body (255) against the press bench (235), and to get a perfect position adjustment of the third body itself, this position usually will be locked during the operation or alternatively will produce a lineal movement for certain operations. The third body (255) comprises an actuation zone by means of an actuator (290). This actuator can be composed by a mechanical, hydraulic, electrical, among others.

Surrounding the third body (255) there is a fourth body (245,280) that is composed of a fixed part (280) usually held to the press frame (295) or to the press bench, and a mobile part (245). This fourth body (245,280) has also a hydraulic cushion (260,265) to generate axial movements, and this cushion has an upper chamber (260) and a lower chamber (265), with the axial movement generated by adding or leaking fluid into the different chambers. The fourth body (245,280) can be manufactured as a hollow cylinder around the third body (255) or by a set of cylinders placed around the third body (255). The fourth body (245,280) will move a set of transfer pins (240) that will transfer the movement to the tool transfer pins (225).

According to the first embodiment shown in FIG. 1, on the press is assembled a tool with a lower base plate (230), a contour punch (215), a scrap coil ejector (210), and a rotary movement transmission mechanism (250) between the third body (255) and the tool components. According to this configuration the contour punch (215) will rotate as much as the actuator (290) generates the rotary movement over the third body (255).

The second body (100), (ram press), is moved by a hydraulic cylinder (105). It comprises a fifth body (115) that is supported by a hydraulic cushion (125,130). This hydraulic cushion has an upper chamber (125) and a lower chamber (130) that will control its axial movement as well as its axial position. This fifth body has the capability to get free rotary movement or also controlled rotary movement by an actuator (not represented in the first embodiment). Said fifth body (115) operates on some transfer pins (150) supported on the tool over a partial circular groove in the upper tool plate. The transfer pins (150) move the ejector (170) through the die (145) held by the upper plate (135). A piercing punch in the center position is represented by (160), and is located in a retaining plate (140) that has a free rotary mechanism, this mechanism can have any shape as it moves under a synchronized movement against the third body (255) when a part is being cut and when the part is being ejected from the tool, and this synchronized movement will be produced by the part itself at a cutting action or will be produced by a controlled rotary movement produced by an actuator.

Figure 2:
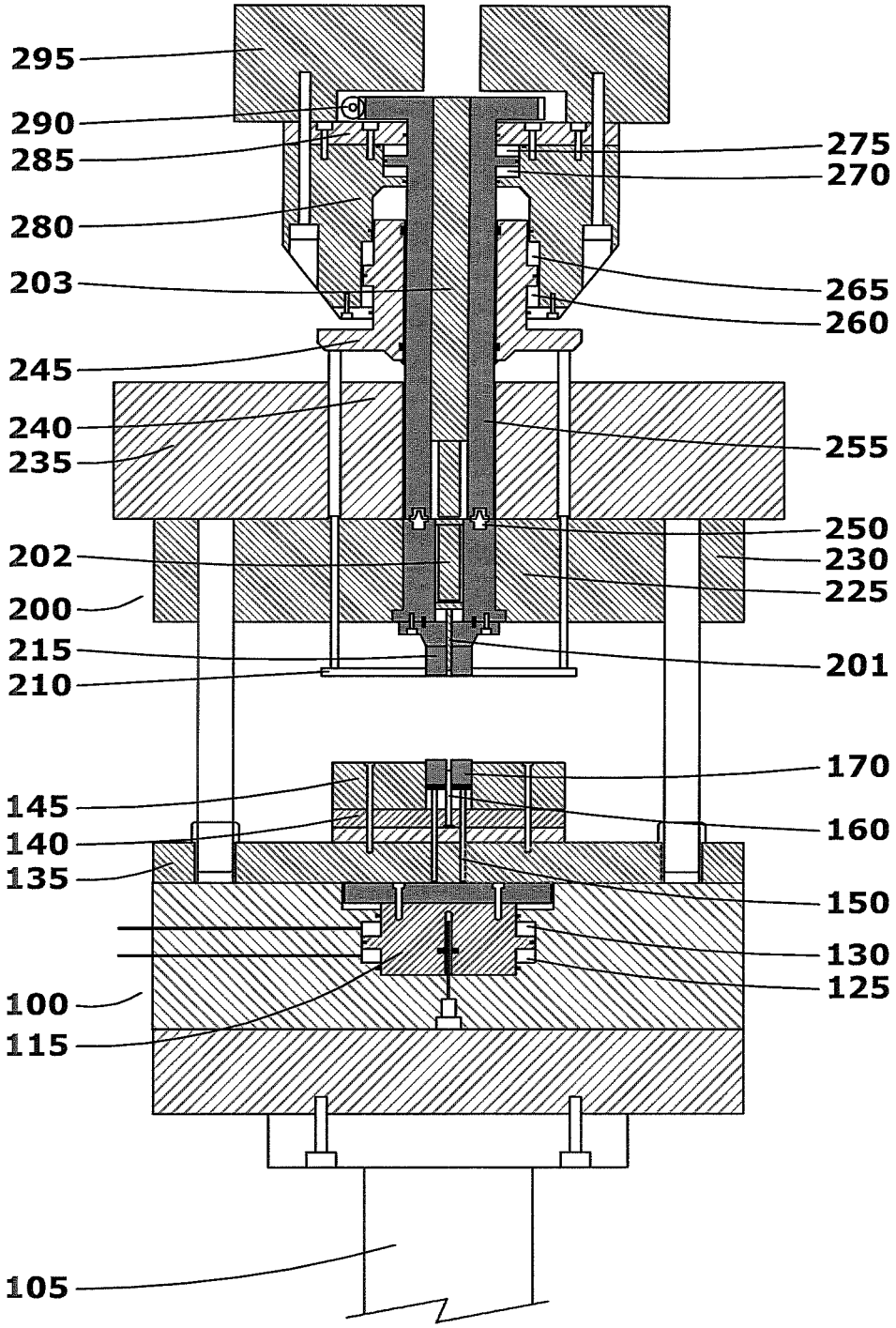
FIG. 2 shows a schematically sectional press view according to a second embodiment, in which the first and second body positions are inverted, as well as their associated components; in this second embodiment the second body constitutes the bench and the first body is the ram, the third rotary body has inside an internal element that has the capability to make linear (axial) movements, such as an ejector, with free or controlled rotary movement.

According to a second embodiment shown in FIG. 2, the press will be in an inverted position with respect to the first embodiment, with the first body (200) in the upper position and the second body (100) in the lower position. The second body in this case is identical to that of the first embodiment.

This position does not allow removing the slugs through the upper part, the third body (255) will have an internal component (203) with lineal movement, with free or controlled rotary movement, or that will hold at its end a device (202) that will have such movement capability. One or more ejectors (201) are held by the device (202).

According to a third embodiment, it can be seen that the press also includes a first body (200) and a second body (300) (it has the same name but different number than that of the first embodiment due to a higher press complexity); the first body (200) is basically equal to the first press model, so it shall not be described again.

Figure 3:
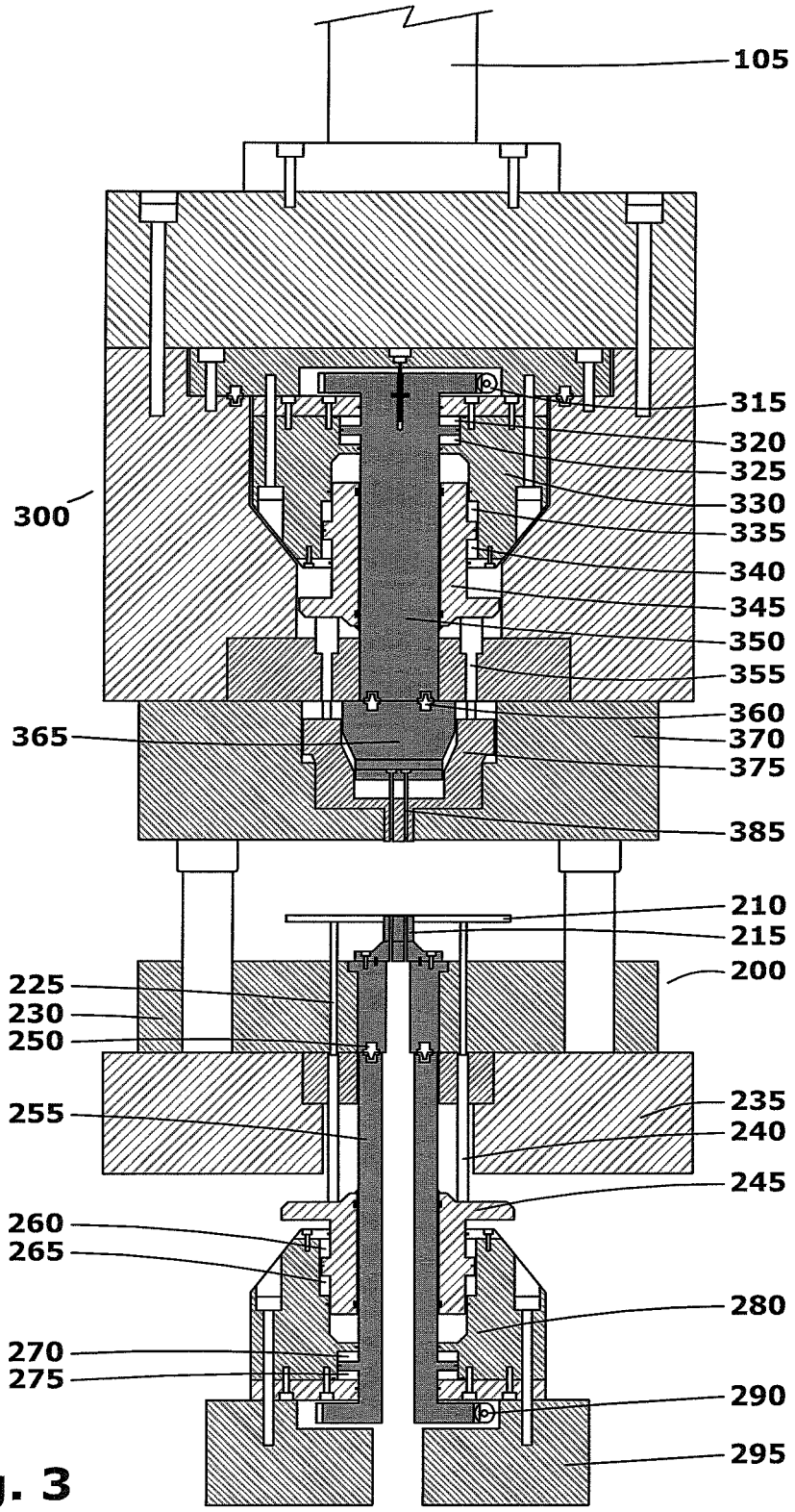
FIG. 3 shows a schematically sectional press view according to a third embodiment in which the first body is substantially identical to that of FIG. 1 where the second body (upper) has a fifth body with controlled rotary movement with one or more punches in a centered or non centered position, said fifth body being inserted inside a sixth body formed by a hollow cylinder with axial movement capability.

The second body, represented in the upper position in FIG. 3, comprises a fifth body (350); this fifth body (350) is a rotary element with respect to said second body (300) and has at least one spindle head (365) associated to or integrated in it. This fifth body (350) is composed by a hydraulic element that is supported hydrostatically by said second body (300). Said fifth body (350) will be usually supported by a hydraulic cushion (320,325) with an upper chamber (320) and a lower chamber (325). The filling or leaking action over those chambers will produce a linear movement of this fifth body (350) with respect to the second body (300) for a perfect position adjustment, and this position usually will be locked during the operation or will produce a linear movement for certain operations. The fifth body (350) has a rotary operation area by means of an actuator (315). This actuator can be composed by a mechanical, hydraulic, electrical, among others.

Surrounding the fifth body (350) there is a sixth body (330,345) that has a fixed part (330) respect to the fifth body (350) and a mobile part (345). This sixth body (330,345) has also a hydraulic cushion (335,340) to generate axial movements, which is formed by an upper chamber (335) and a lower chamber (340) and filling or leaking those chambers will be produce the desired movement. The sixth body (330,345) can be composed by a hollow cylinder crossed through by the fifth body (350) or be composed by a set of hydraulic or electromechanical elements placed around the fifth body (350). The sixth body (330,345) will move a set of transfer pins (355) that will act on an ejector (375). The ejector (375) moves with axial and/or rotary movement inside the die (370). The ejector (375) is fitted to the spindle head (365) of the fifth body (350). The fifth body (350) and the spindle head (365) are usually assembled by means of a joint (360) in such a way that the first one transmits to the second one the synchronized rotary movement, and this spindle head (365) transmits the rotary movement to the ejector (375). Held by the spindle head (365) are placed punches (385) that move together with the spindle head in all its axial or rotary movements.

According to a particular design the ejector (375) has a pattern with some internal axial grooves that engage to a similar external axial groove pattern of the spindle head (365), with free relative axial movement, but with synchronized rotary movement with respect to each other; nevertheless, as an alternative design both, the spindle head and the ejector, can have independent rotary movements acted by respective actuators with synchronized movements by means of a corresponding programming operation.

Figure 4:
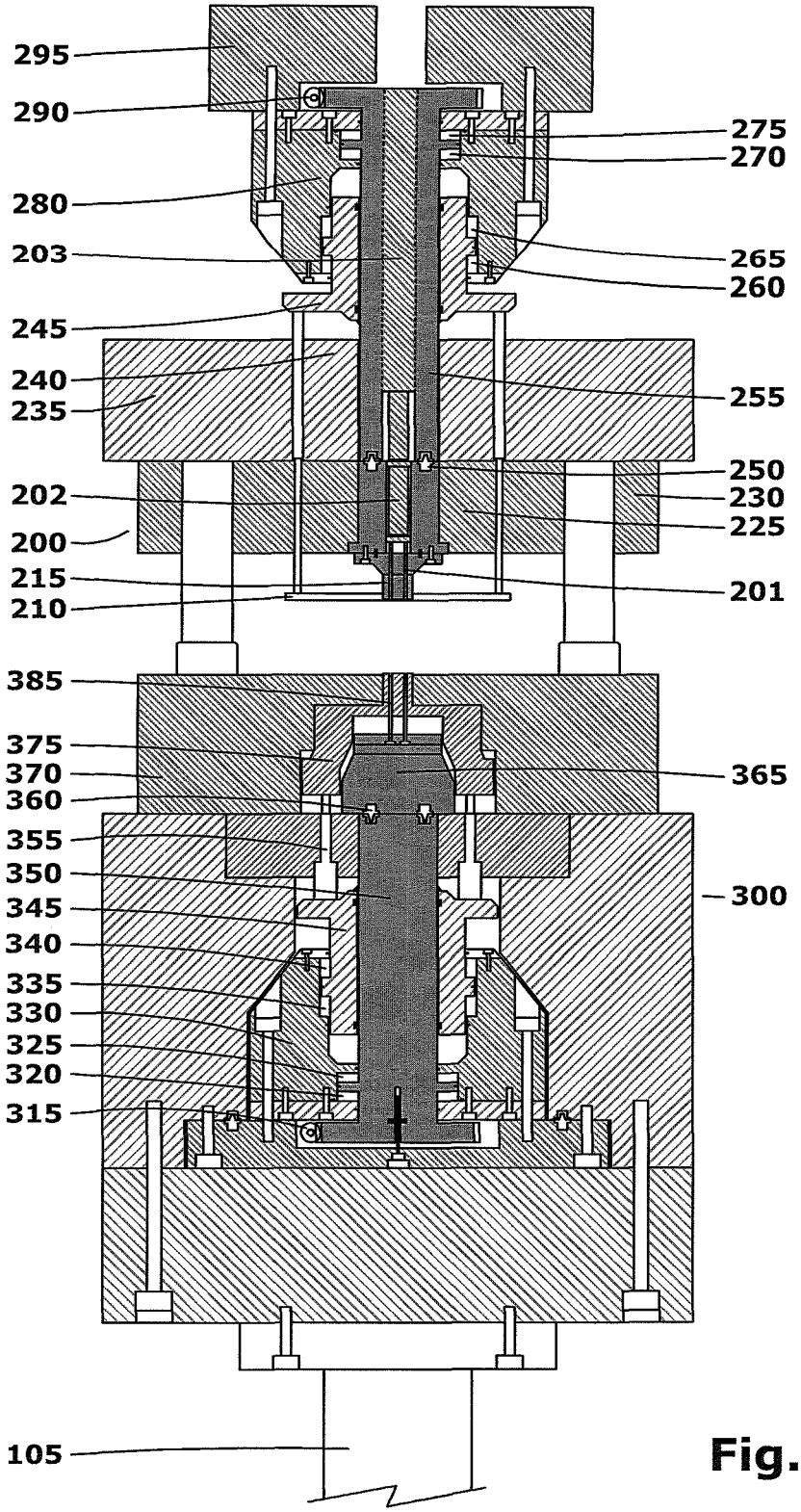
FIG. 4 shows a sectional press view according to a fourth embodiment in which are combined the features of the first body of FIG. 2 with the features of the second body of FIG. 3, in an inverted position.

According to a fourth embodiment shown in FIG. 4, the press is in an inverted position respect to the third embodiment, with the first body (200) in the upper position and the second body (300) in the lower position. The first body (200) is essentially the same as that of second embodiment, and the second body (300) substantially identical to that of the third embodiment. The internal mobile component (203) can hold one or more rotary elements in concordance to the rotary elements of the second body.

Figure 5:
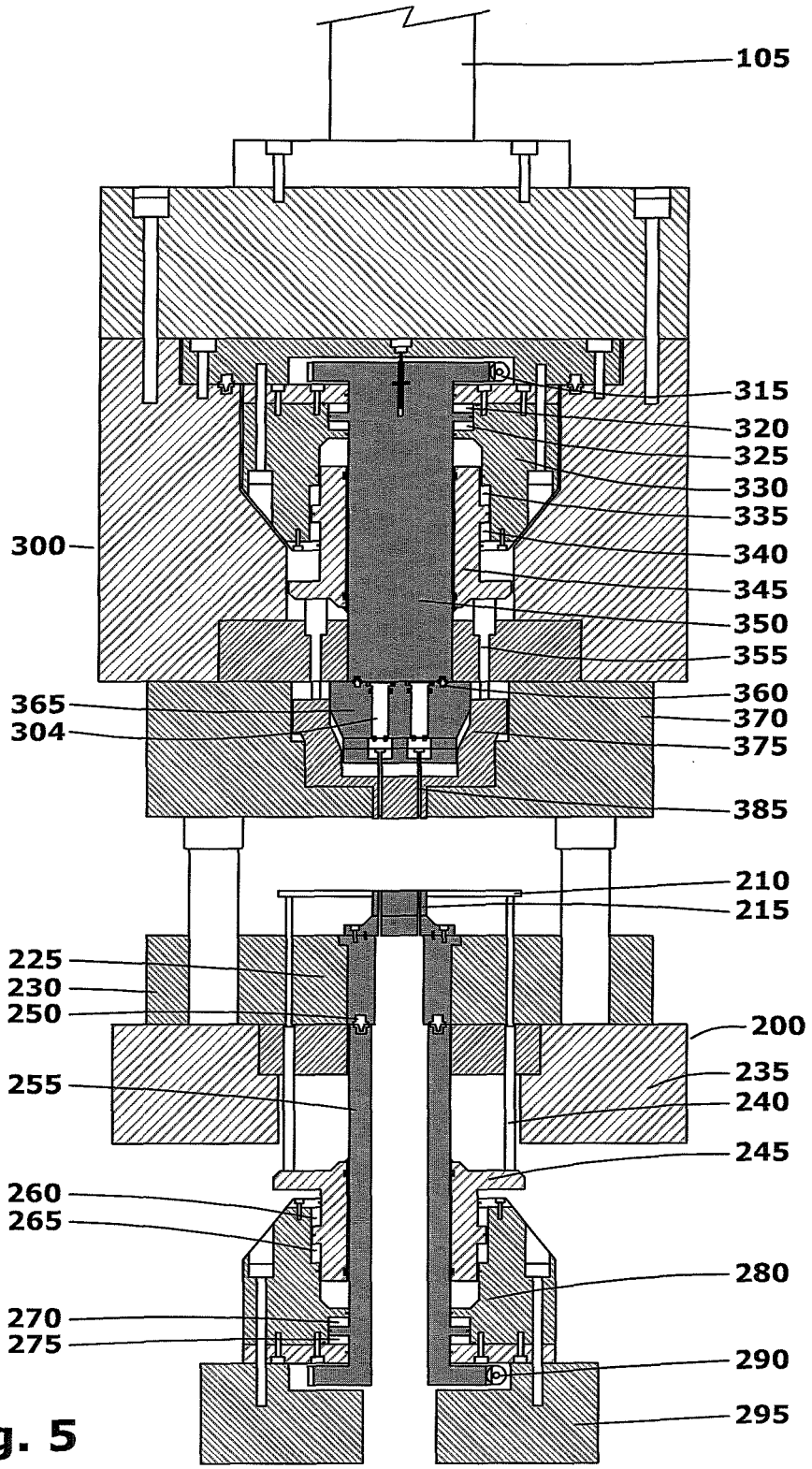
FIG. 5 shows a schematically sectional press view according to a fifth embodiment in which the first body is basically identical to those of FIGS. 1 and 3, and where the second body in addition to the fifth and sixth bodies of FIG. 3 comprises one or more independent elements with controlled rotary movement.

According to a fifth embodiment shown in FIG. 5, similar to the third embodiment, the fifth body which has axial and rotary movements capability, and is supported by the second body (300) has at least one spindle head (365) that has one or more rotary elements (304) integrated in it. Nevertheless, the spindle head can be integrated in the fifth body itself. These rotary elements (304) are actuated by an actuator that allows a positional and speed controlled movement of these rotary elements (304). The first body is essentially identical to that in the third embodiment.

Figure 6:
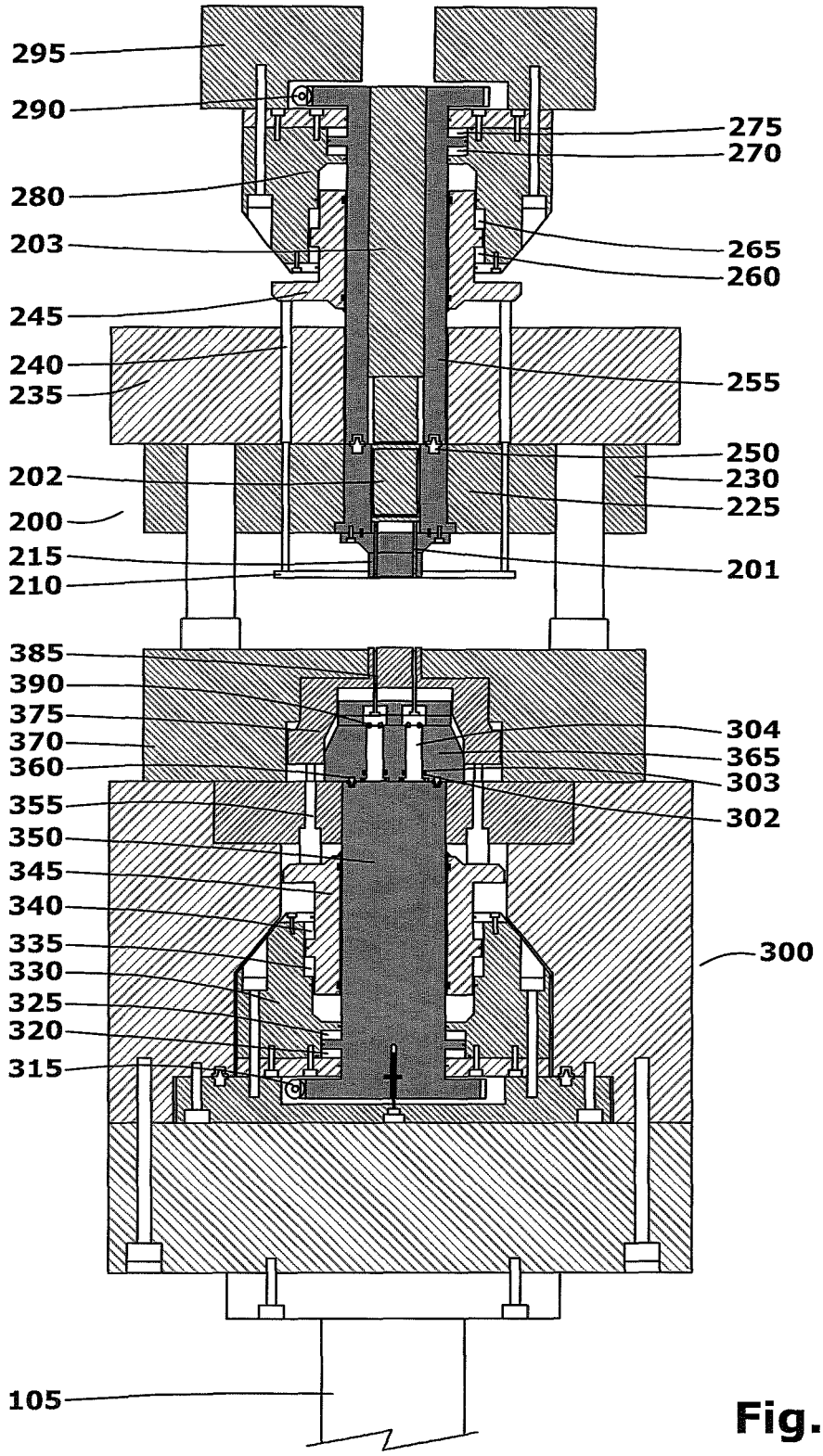
FIG. 6 combines the features of the first body of FIGS. 2 and 4 with the second body of FIG. 5 in an inverted position; the internal element of the third body can have one or more rotary elements.

According to a sixth embodiment shown in FIG. 6, the position of the first body (200) and the second body (300) are inverted, and the third body supported by the first body, as in the fourth embodiment, is provided with at least one internal element with axial and maybe also rotary movements, or can have independents rotary elements.

Figure 7:
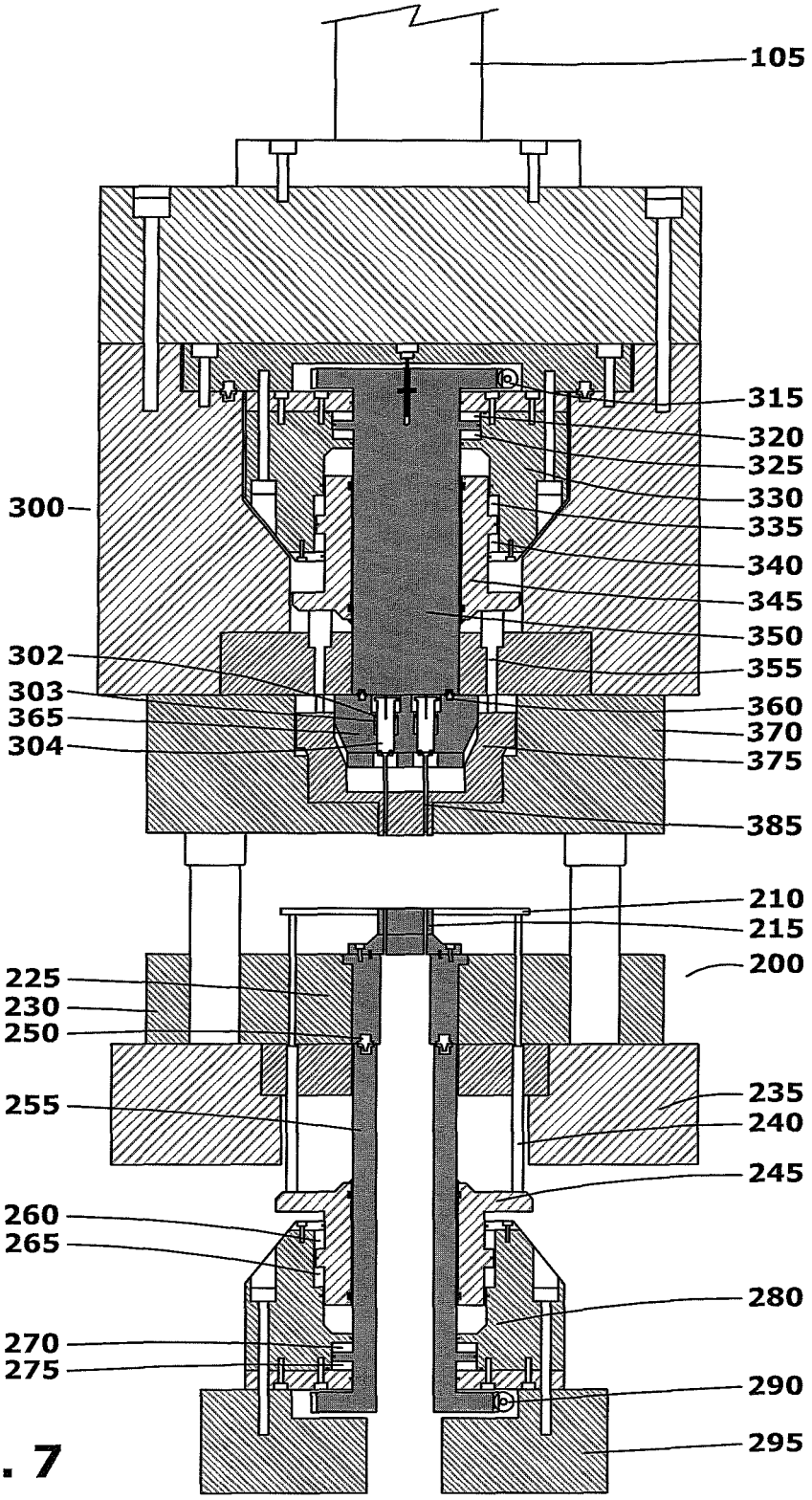
FIG. 7 shows a schematically sectional press view according to a seventh embodiment, in which the first body is basically identical to the one show in FIGS. 1, 3 and 5, and the second body is as that of FIG. 5, but where the independent elements of the fifth body have also axial controlled movement capability.

A more complex press design is done by the seventh embodiment shown in FIG. 7. In addition to the elements of the fifth embodiment, the rotary elements (304) held by the spindle head (365) which in turn is held by the fifth body (350) have axial controlled movement capability. This movement capability comes from a hydraulic component, as an example a hydraulic cylinder with simple or double action with an upper chamber (302) and a lower chamber (303), with both speed and position controlled.

Figure 8:
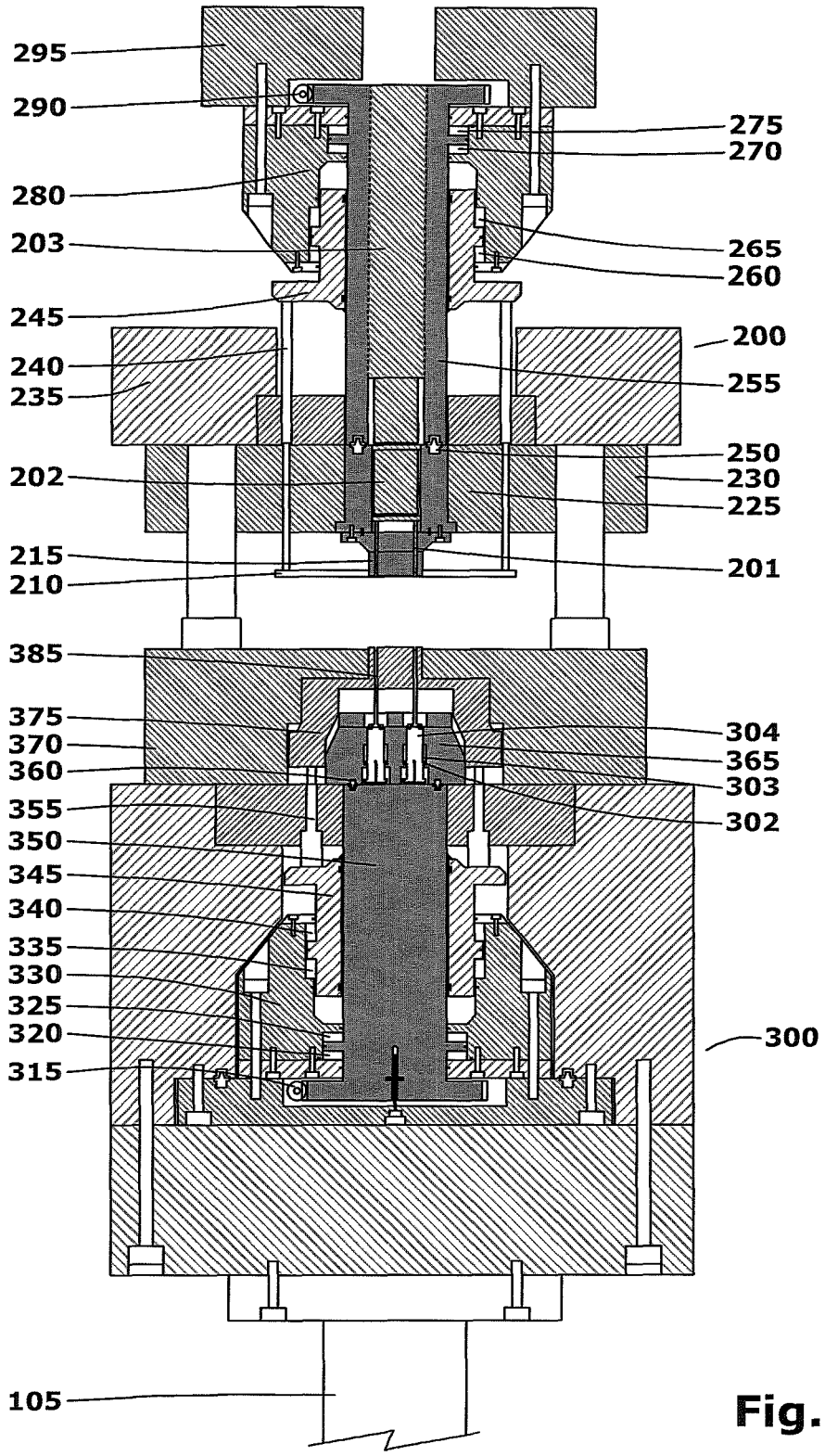
FIG. 8 combines the features of the first body of FIG. 6 with the second body of FIG. 7, but in an inverted position.
Figure 9:
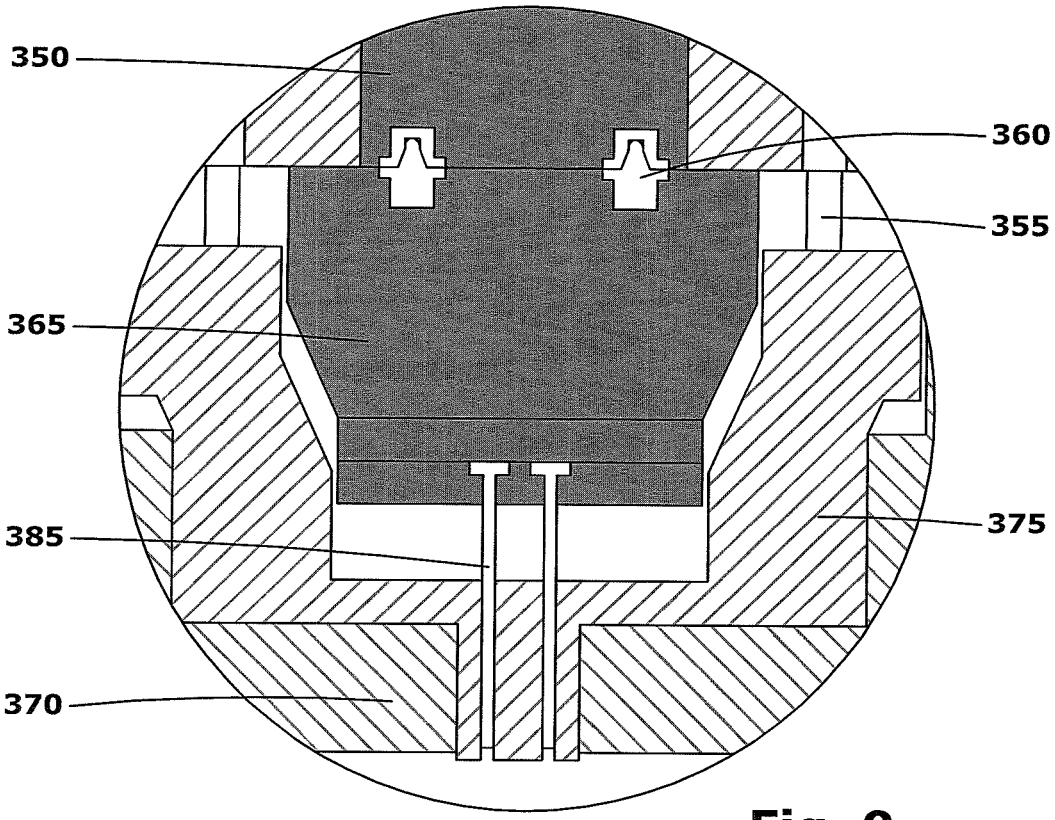
FIG. 9 shows a detail of a spindle head in the fifth body according to FIGS. 3 and 4 in which is shown a punch retaining system.
Figure 10:
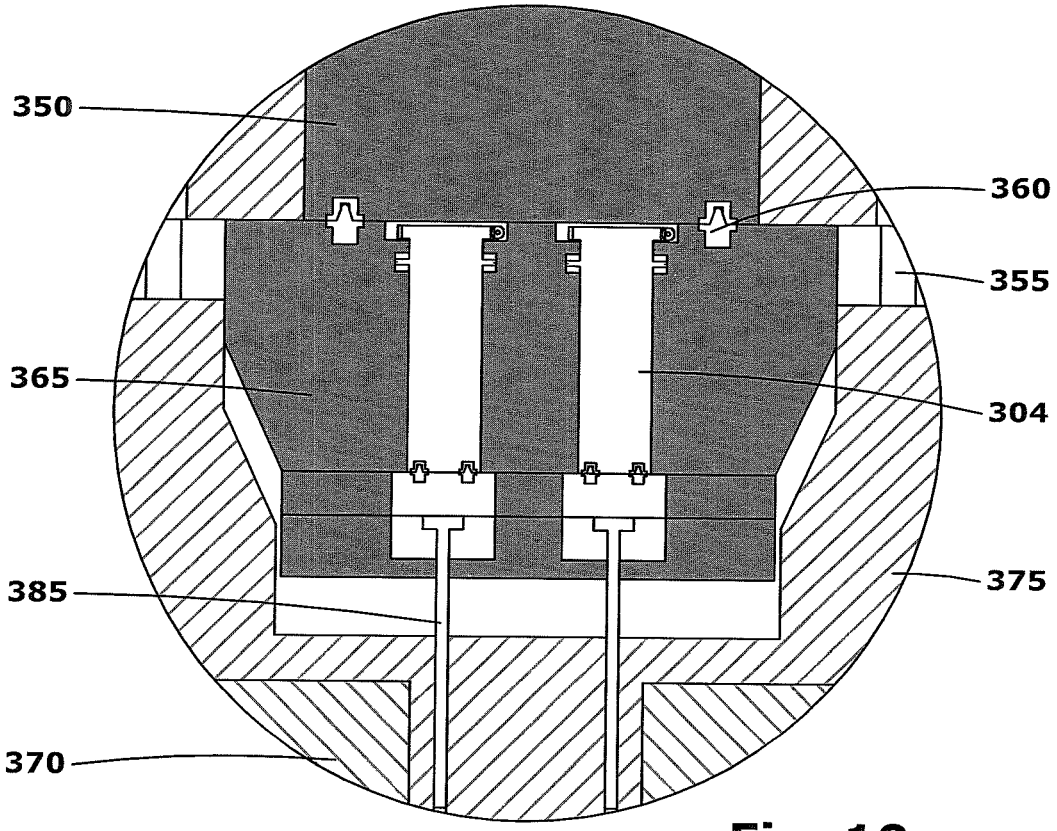
FIG. 10 shows a detail from a spindle head at the fifth body according to FIGS. 5 and 6 where the independent elements with controlled rotary movement capability and the punches that they hold can be seen.
Figure 11:
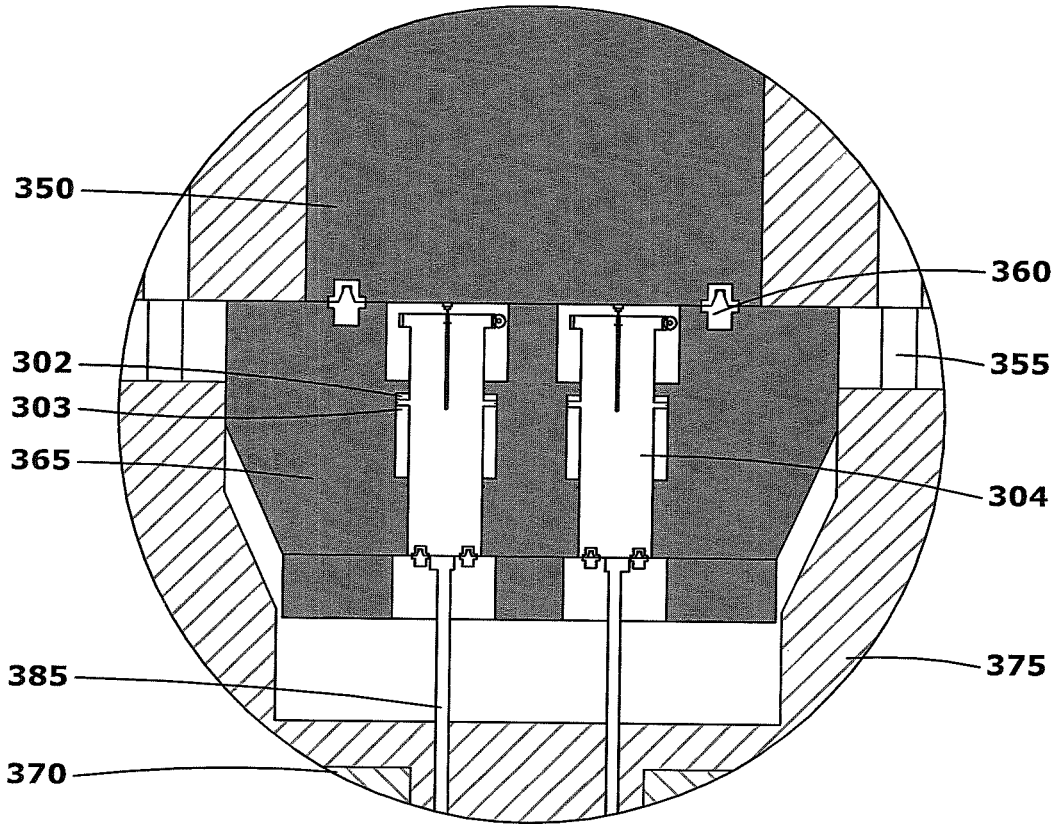
FIG. 11 Shows a detail from a head at the fifth body according to embodiments of FIGS. 7 and 8 in which the independent elements with controlled rotary movement capability and controlled axial (lineal) movement with the punches that they hold can be seen.

According to an eighth embodiment shown in FIG. 8, the positions of the first and second bodies are inverted, the first body in essence is similar to the one on the sixth embodiment, and the second body is in essence like the one on the seventh embodiment.

According to the part to be manufactured, the press will have also a tool with certain internal components with the capability to have independent axial or rotary movements, whose operation movements are transferred by the press to the tool components independently.

In the explanation given above, the expression "controlled movement" means a movement with instant exact position and speed at the time the press has control of them, being said movements acted by means of actuators.

The references to the axial or linear movements describe the approaching or moving away movements between the first and the second press bodies or the components that they hold.

Even when certain systems are described as hydraulic systems as they are the most commonly used systems in this kind of applications, the actuators could also be electromechanical or others within the purpose of the present invention.

As the axial movements of the first and the second bodies are relative to each other, the operation can be of one, the other or both.

What is claimed is:

1. Stamping press for stamping a metal blank into a metal coil, comprising:

a first body, a second body, at least one of the first body and second body having an axial movement, the first body holding a third body for controlled rotary movement, a hydraulic cushion which supports the third body, said third body having an actuator to provide said rotary movement, the second body holding a fifth body for rotary movement, a hydraulic cushion which supports the fifth body, the rotary movements of the third body and the fifth body as well as axial movements of the first body and the second body being independent with respect to each other;

a contour punch;

a scrap coil ejector;

the first body has, surrounding the third body, a fourth body with axial movement capability with respect to said third body;

a hydraulic cushion which supports the fourth body to eject scrap from the metal coil cut out by the contour punch with the scrap coil ejector, the scrap being formed as slugs deriving from parts punched by the contour punch to form pierced holes;

the fifth body ejecting a finished part out of the stamping press;

wherein the independent linear and rotary movements produce a variable pitch on blanked parts according to a variation of feed movements of the first body, the second body against the rotation movements of the third body and the fifth body during a single blanking action of a single press cycle.

2. Stamping press according to claim 1, wherein the third body is hollow, and wherein the slugs are removed through a hollow portion of the third body.

3. Stamping press according to claim 1, further comprising an internal ejector to remove the slugs through ejector pins and a device which engages the ejector pins, the internal ejector having a rotary movement and an axial movement.

4. Stamping press according to claim 3, wherein the internal ejector is held by the third body and has at least one element for rotary movement.

5. Stamping press according to claim 1, wherein the fourth body is formed as a casing around the third body and includes a fixed element fitted to one of a press frame and a press bench, and a mobile element movable with respect to said third body.

6. Stamping press according to claim 1, wherein the fourth body is formed by one of:

a set of acting hydraulic elements and a set of acting electromechanical elements placed around the third body.

7. Stamping press according to claim 1, wherein the third body includes at least one spindle head.

8. Stamping press according to claim 1, further comprising a tool with mobile components having at least one of axial and rotary movements operated by the stamping press.

9. Stamping press according to claim 1, wherein the fifth body has a free rotary movement.

10. Stamping press according to claim 1, wherein the fifth body has a controlled rotary movement powered by an actuator.

11. Stamping press according to claim 10, wherein the second body includes, placed around the fifth body, a sixth body with axial movement capability.

12. Stamping press according to claim 11, wherein the sixth body is formed as a casing around the fifth body and includes a fixed component held to a ram of the stamping press and a mobile element.

13. Stamping press according to claim 11, wherein the sixth body is formed by one of:

a set of acting hydraulic elements and a set of acting electromechanical elements placed around the fifth body.

14. Stamping press according to claim 10, further comprising a spindle head that moves together with the fifth body.

15. Stamping press according to claim 14, further comprising an ejector with axial movement and controlled rotary movement powered by the actuator, the ejector having an internal axial groove contour, and the spindle head having an external axial groove contour allowing free relative axial movements as well as direct rotary movement transmission with respect to each other.

16. Stamping press according to claim 14, wherein the spindle head has at least one rotary element with controlled movement.

17. Stamping press according to claim 16, wherein the at least one rotary element has a controlled axial movement.

18. Stamping press according to claim 1, wherein the fifth body comprises different independent spindle heads.

19. Stamping press according to claim 1, wherein a single press frame of the stamping press is adapted to hold more than one operation unit.

* * * * *